US006403235B1

(12) United States Patent
Glidden et al.

(10) Patent No.: US 6,403,235 B1
(45) **Date of Patent: *Jun. 11, 2002**

(54) STRENGTH AND WEAR RESISTANCE OF MECHANICAL COMPONENTS

(75) Inventors: Gregory L. Glidden, Spring, TX (US); Thomas McNeilly, Coatbridge (GB); Manuel N. Maligas, Houston, TX (US)

(73) Assignee: FMC Corporation, Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 54 days.

(21) Appl. No.: 08/984,804

(22) Filed: Dec. 4, 1997

(30) Foreign Application Priority Data

Dec. 5, 1996 (GB) ..... 9625331

(51) Int. Cl.[7] ..... F01D 9/06; B32B 15/18

(52) U.S. Cl. ..... 428/679; 428/683; 428/685; 148/518; 148/529; 148/530

(58) Field of Search ..... 428/679, 685, 428/683; 148/518, 529, 530

(56) References Cited

U.S. PATENT DOCUMENTS 4,455,352 A * 6/1984 Ayres et al.
5,049,716 A 9/1991 Dunmire et al. ..... 219/76.14
5,137,422 A * 8/1992 Price et al.
5,906,896 A * 5/1999 Jackson et al.

FOREIGN PATENT DOCUMENTS

| | | | |
|---|---|---|---|
| EP | 0092621 A2 | 11/1983 | ..... B23K/35/30 |
| EP | 0269006 A2 | 6/1988 | ..... C23C/2/06 |
| EP | 0480355 A2 | 4/1992 | ..... C25D/3/56 |
| GB | 1581172 | 12/1980 | ..... C23C/7/00 |
| GB | 2076432 A | 12/1981 | ..... C23C/9/00 |
| GB | 2161499 A | 1/1986 | ..... C23C/22/78 |
| GB | 2177040 A | 1/1987 | ..... B23K/9/04 |
| GB | 2225591 A | 6/1990 | ..... C25D/5/00 |
| GB | 2231062 A | 11/1990 | ..... C23C/2/28 |
| GB | 2234259 A | 1/1991 | ..... C25D/5/14 |
| GB | 2243843 A | 11/1991 | ..... C23C/2/06 |

OTHER PUBLICATIONS

DeAntonio et al., Heat Treating Superalloys, Metals Handbook vol. 4, pp. 793–814, Jun. 1995.*

* cited by examiner

*Primary Examiner*—Deborah Jones
*Assistant Examiner*—Jason Savage
(74) *Attorney, Agent, or Firm*—James L. Jackson; Andrews, Kurth, Mayor, Day, Caldwell & Keeton

(57) ABSTRACT

The strength and wear resistance of a steel component is improved by adhering to it a material of higher strength compatible metal alloy, such as Inconel (RTM) 725 or like precipitation or age hardenable alloy. The higher strength alloy may be adhered by welding, plasma spraying, dip coating or electroplating. The component may be subjected to post-deposition heat treatment which preferably simultaneously softens a heat affected zone in the component and hardens the higher strength material.

14 Claims, No Drawings

STRENGTH AND WEAR RESISTANCE OF MECHANICAL COMPONENTS

This invention relates to mechanical components having improved strength and wear resistance, and is described below with particular reference to oil and gas field equipment, although being of more general applicability.

Oil and gas production equipment is for the most part made from relatively low cost stainless or carbon steel alloys. In many instances the components concerned are required to function safely in hydrogen sulphide bearing or other corrosive environments such as those containing $CO_2$ or acids, hence the components must meet corrosion resistance standards such as National Association of Corrosion Engineers (NACE) standard MR-01-75. For alloy steels this limits the material hardness to a maximum of 22 Rockwell C, which in turn limits the maximum material strengths in tensile, yield and bearing.

In critical areas such as tubing hanger load shoulders and grooves, applied loads can exceed the capability of the restricted hardness steel. Here it has been the practice to use higher strength alloys (for example nickel rich steels such as Inconel (RTM) 718 or K Monel (RTM) 500) which are also very costly. In order to reduce material costs somewhat it is known to use higher strength (e.g. nickel alloy) inserts to distribute high load stresses from a small surface area at, for example, a load shoulder, to a larger surface area on a lower strength component, thereby avoiding the need to form the entire component from costly high strength material.

A further problem arises in critical seal bores such as for wireline plugs, pressure vessel connections and in production bore seal sleeves: that is in providing sufficient wear and corrosion resistance. Corrosion resistant base materials such as F6NM martensitic or Super Duplex stainless steels are often used at such locations, or the sealing surfaces are weld overlaid with 316SS or Inconel (RTM) 625 alloys. Whilst providing improved corrosion resistance, such materials and overlays are relatively soft and therefore prone to wear damage from erosive flows, mechanical loads and scoring.

We have realised that both the problem of improving wear resistance and the problem of improving the strength of a steel component can be met by augmenting the component with compatible higher strength materials.

Accordingly the present invention provides a steel component having improved strength and wear resistance achieved by adhering to the component a material of higher strength compatible metal alloy. The higher strength material is preferably deposited by welding, although other deposition techniques such as plasma spraying, dip coating or electro-plating can be used. If necessary the component thus formed may be heat treated to remove residual stresses and soften the Heat Affected Zone (HAZ) to NACE allowable values. The deposited material may be selected such that it is hardened by the heat treatment. For example the deposited material may be a precipitation hardenable alloy. A possible deposit material is Inconel (RTM) 725, available in welding wire form from Inco Europe Limited of $5^{th}$ Floor, Windsor House, 50 Victoria Street, London SW1H 0XB. Possible component base materials are AISI 4130, AISI 8630 Mod 3 and ASTM-A182 F6NM steels. (AISI=American Iron & Steel Institute; ASTM=American Society for Testing of Materials).

The invention also provides corresponding methods of improving the strength and wear resistance of steel components.

Further preferred features of the invention are in the dependent claims or will be apparent from the following description of illustrative examples and embodiments.

With the increasing trend towards high pressure, deep well completions and resulting highly loaded support and retention shoulders, the strength of the parent material of the wellhead components is often insufficient to meet the required design criteria. This is particularly so for multi-bowl, hanger stacking and latch groove applications within wellheads. In this context the invention enables the use of low cost alloys for the wellhead component base material by increasing the strength of the load shoulders and lockdown grooves in these highly stressed areas. This may be achieved cost effectively using a deposit of high strength Inconel (RTM) 725 or other compatible precipitation hardenable alloy.

The deposit may be used for sealing surfaces, where its hardness properties afford increased resistance to abrasion and scoring in service. This is particularly advantageous where multiple make and break operations are carried out as in riser connections or in areas on components which cannot be made intrinsically scratch and wear resistant due to design related constraints.

The deposition may be carried out using any suitable conventional process, such as TIG, MIG or SMAW welding, plasma spraying, dip coating or plating processes, using hand-held or automatic equipment, as best suited to the particular application. Post weld or post deposition heat treatment may then be carried out, if applicable. This relieves any stresses built up in the HAZ and reduces the hardness in this area to within NACE allowable values. This stress relieving process may also age the deposited material overlay, increasing its strength. After heat treatment, any necessary finishing operations such as machining, grinding and polishing are then carried out. The following examples illustrate the results of test studies performed in order to determine acceptable processes for the localised deposition of Inconel (RTM) 725 onto AISI 4130, AISI 8630 Mod 3 and ASTM-A182 F6NM steels, by welding.

EXAMPLE 1

Base Material: AISI 4130

Standard temperature stress relief cycle: 640° C. for 4 hours

Lowest temperature acceptable stress relief cycle: 625° for 4 hours

Deposit minimum tensile strength $138.2\times10^3$ lb/in$^2$ (953 MNm$^{-2}$)

Deposit minimum yield strength $94.3\times10^3$ lb/in$^2$ (650 MNm$^{-2}$)

Deposit maximum hardness (Rockwell C) 26.2

Actual stress relief temperature selected is dependent upon the base material's original heat treatment tempering temperature. A typical value for material of this type is 660° C. Stress relief is preferably carried out at about 20° C. below this temperature giving the figure of 640° C. appearing above.

At stress relief temperatures lower than about 625° C. the hardness of the HAZ will not fall to NACE allowable values. Stress relieving temperatures lower than about 625° C. should preferably therefore be avoided.

EXAMPLE 2

Base Material AISI 8630 Mod 3

Stress relief cycle: 655° C. for 5 hours

Deposit minimum tensile strength: $145.0\times10^3$ lb/in$^2$ (1000 MNm$^{-2}$)

Deposit minimum yield strength: $104.8\times10^3$ lb/in$^2$ (722 MNm$^{-2}$)

Deposit maximum hardness (Rockwell C) 34.5

For Mod 3 and the other richer chemistries typical in Europe it is believed that this stress relief cycle will produce consistently satisfactory results.

The US plain AISI 8630 material is less rich in strengthening elements and may require a lower stress relief temperature to obtain acceptable base material mechanical properties. In this case, results (in particular the mechanical properties of the deposited material) similar to AISI 4130 will be achieved. The Mod 3 or other richer chemistries are therefore preferred for the base material if a deposit strength greater than 100000 psi (690 $MNm^{-2}$)is needed.

EXAMPLE 3

Base Material ASTM-A182 F6NM

Stress relief cycle: 670° C. for 10 hours, followed by 615° C. for 10 hours.

Deposit minimum tensile strength $158.6\times10^3$ lb/in$^2$ (1094 $MNm^{-2}$)

Deposit minimum yield strength $120.6\times10^3$ lb/in$^2$ (832 $MNm^{-2}$)

Deposit maximum hardness (Rockwell C) 34.9

What is claimed:

1. A steel component material composed of steel selected from a group consisting of AISI 4130, AISI 8630 MOD3 and ASTM-A182 F6NM steels having a defined range of tensile strength, yield strength and hardness and having improved strength and wear resistance achieved by adhering to a heat affected zone of the steel component by welding, plasma spraying or dip coating a cladding of high strength precipitation hardenable or age hardenable Inconel (RTM) 725 metal alloy material of higher tensile strength, yield strength and hardness as compared with said defined range of tensile strength, yield strength and hardness, the Inconel (RTM) 725 metal alloy of the metal clad steel component being subjected to post-deposition heat treatment to soften the heat affected zone of the steel component and simultaneously harden the cladding of precipitation hardenable or age hardenable Inconel (RTM) 725 metal alloy material on the heat affected zone.

2. The steel component as defined in claim 1 wherein said steel material comprises AISI 4130 steel, wherein following deposition of said cladding of precipitation hardenable or age hardenable Inconel (RTM) 725 metal alloy material, the heat affected zone of the clad steel component has been subjected to a temperature of substantially 640° C. to substantially 625° C. for substantially four hours.

3. The steel component as defined in claim 1 comprising AISI 8630 steel wherein, following deposition of said cladding of precipitation hardenable or age hardenable Inconel (RTM) 725 metal alloy material, said heat affected zone of the clad steel component has been subjected to a temperature of substantially 655° C. for substantially five hours.

4. The steel component as defined in claim 1 wherein said steel material comprises ASTM-A182 F6NM steel wherein, following deposition of said cladding of precipitation hardenable or age hardenable Inconel (RTM) 725 metal alloy material, the heat affected zone of the clad steel component has been subjected to a temperature of substantially 670° C. for substantially ten hours, followed by a temperature of substantially 615° C. for substantially ten hours for stress relief of the heat affected zone to NACE allowable values and to age harden said Inconel (RTM) 725 metal alloy material.

5. A steel component composed of a steel material selected from a group consisting of AISI 4130, AISI 8630 MOD3 and ASTM-A182 F6NM steels having a defined range of tensile strength, yield strength and hardness and having improved strength and wear resistance achieved by a cladding of high strength Inconel (RTM) 725 metal alloy having greater tensile strength, yield strength and hardness as compared to said steel material and wherein said cladding of Inconel (RTM) 725 metal alloy is deposited on a heat affected zone of said steel component by welding, plasma spraying or electroplating and after being so deposited is heat treated within a temperature range of from about 625° C. to about 640° C. for a period of from about four hours to about five hours to remove residual stresses and to soften the heat affected zone and harden said cladding of high strength Inconel (RTM) 725 metal alloy.

6. The steel component of claim 5, wherein said steel material is AISI 4130 steel.

7. The steel component of claim 5, wherein said steel material is AISI 8630 Mod 3 steel.

8. A steel component being composed of a steel material selected from a group including ASTM-A182 F6NM steel, AISA 4130 steel and AISI 8630 MOD3 steel and having a defined range of tensile strength, yield strength and hardness and having improved strength and wear resistance by a cladding of high strength Inconel (RTM) 725 precipitation hardenable metal alloy deposited on said steel component by welding and after being so deposited is heat treated at a temperature of about 670° C. for about 10 hours, followed by heat treating at a temperature of about 615° C. for about 10 hours to remove residual stresses and to harden said cladding of high strength Inconel (RTM) 725 precipitation hardenable metal alloy.

9. A method of improving the strength and wear resistance of a localized zone of a steel component composed of a steel material selected from a group consisting of AISI 4130, AISI 8630 MOD3 and ASTM-A182 F6NM steels having a defined range of tensile strength, yield strength and hardness, comprising the step of adhering to the localized zone of the steel component by welding, plasma spraying or dip coating a cladding of precipitation hardenable or age hardenable Inconel (RTM) 725 metal alloy material of higher tensile strength, yield strength and hardness as compared with the defined range of tensile strength, yield strength and hardness of the steel component, the Inconel (RTM) 725 metal alloy clad steel component being subjected to post-deposition heat treatment to soften the localized heat affected zone to NACE allowable values for its intended service and simultaneously harden the cladding of precipitation hardenable or age hardenable Inconel (RTM) 725 metal alloy material.

10. A method of improving the strength and wear resistance of a localized zone of a steel component composed of steel material selected from a group consisting of AISI 4130, AISI 8630 MOD3 and ASTM-A182 F6NM steels and having a defined range of tensile strength yield strength and hardness, comprising the step of adhering to the localized zone of the steel component by welding a cladding of a precipitation hardenable or age hardenable metal alloy of higher tensile strength, yield strength and hardness as compared with the tensile strength, yield strength and hardness of the steel component and subjecting the localized zone of the metal alloy clad steel component to post-deposition heat treatment to soften a heat affected zone in the steel component to NACE allowable values and simultaneously harden the cladding of precipitation hardenable or age hardenable metal alloy.

11. A method of improving the strength and wear resistance of a localized zone of a steel component composed of a steel material selected from a group consisting of AISI 4130, AISI 8630 MOD3 and ASTM-A182 F6NM steels having a defined range of tensile strength yield strength and hardness, comprising the step of adhering to the steel component by welding on the localized zone a cladding of Inconel (RTM) 725 metal alloy of higher tensile strength, yield strength and hardness as compared with the tensile strength, yield strength and hardness of the steel component and the step of subjecting the metal clad steel component to post-deposition heat treatment to soften the localized heat affected zone in the steel component to NACE allowable values and simultaneously harden the cladding of Inconel (RTM) 725 metal alloy.

12. The method as defined in claim 11, wherein the steel material of said steel component comprises AISI 4130 steel and following deposition by welding of the cladding of Inconel (RTM) 725 metal alloy on the localized zone, the steel component and its cladding of Inconel (RTM) 725 metal alloy is subjected to a temperature of substantially 640° C. to 625° C. for substantially four hours.

13. The method as defined in claim 11, wherein the steel material of said steel component comprises AISI 8630 steel and following deposition of the cladding of Inconel (RTM) 725 metal alloy on the localized zone by welding, the steel component and its Inconel (RTM) 725 cladding is subjected to a temperature of substantially 655° C. for substantially five hours.

14. The method as defined in claim 11, wherein the steel material of the steel component comprises ASTM-A182 F6NM steel and following deposition of the cladding of Inconel (RTM) 725 metal alloy to the localized zone by welding, the steel component and its cladding of Inconel (RTM) 725 metal alloy is subjected to a temperature of substantially 670° C. for substantially ten hours, followed by a temperature of substantially 615° C. for substantially ten hours to harden said cladding of Inconel (RTM) 725 metal alloy and to soften said localized zone.

* * * * *